US006601505B2

(12) United States Patent
Tokiwa

(10) Patent No.: US 6,601,505 B2
(45) Date of Patent: Aug. 5, 2003

(54) SYNCHRONOUS CONTROL APPARATUS OF A ROTARY PRESS FOR SELECTING A CONTROL TARGET BASED ON PRINTING IMAGE INFORMATION

(75) Inventor: Shizurou Tokiwa, Zushi (JP)

(73) Assignee: Tokyo Kikai Seisakusho, Ltd. (JP)

( * ) Notice: Subject to any disclaimer, the term of this patent is extended or adjusted under 35 U.S.C. 154(b) by 0 days.

(21) Appl. No.: 10/013,111

(22) Filed: Dec. 6, 2001

(65) Prior Publication Data

US 2002/0139261 A1 Oct. 3, 2002

(30) Foreign Application Priority Data

Jan. 11, 2001 (JP) ..... 2001/003357

(51) Int. Cl.[7] ..... B41F 7/02; B41F 13/02

(52) U.S. Cl. ..... 101/218; 101/171; 101/181; 101/221

(58) Field of Search ..... 101/218, 221, 101/484, 181, 248, 171, 216

(56) References Cited

U.S. PATENT DOCUMENTS 6,198,494 B1 * 3/2001 Haraguchi et al. ..... 347/232
6,343,549 B1 * 2/2002 Tokiwa ..... 101/248
6,354,214 B1 * 3/2002 Tokiwa ..... 101/484
2001/0018872 A1 * 9/2001 Tokiwa ..... 101/221
2002/0056381 A1 * 5/2002 Tokiwa ..... 101/174
2002/0144609 A1 * 10/2002 Tokiwa ..... 100/155

FOREIGN PATENT DOCUMENTS

| | | |
|---|---|---|
| JP | Hei 5-64882 | 3/1993 |
| JP | Hei 6-47905 | 2/1994 |
| JP | Hei 8-85196 | 4/1996 |
| JP | Hei 10-114058 | 5/1998 |

* cited by examiner

*Primary Examiner*—Charles H. Nolan, Jr.
(74) *Attorney, Agent, or Firm*—McGlew and Tuttle, P.C.

(57) ABSTRACT

To provide a synchronous control apparatus in a rotary press having a plurality of multicolor printing units to print the synchronous control apparatus including a printing image allocation setting section for allocating printing images which printing couples are to print, a drive unit for driving the printing couples, an inking transmission unit, a first moving unit for moving blanket cylinders of two sets of printing couples, a second moving unit for making it possible to supply ink, slave control sections for controlling rotation of the drive unit, a transmission unit related to the printing couples and inking devices, operation control sections for controlling operations of the first moving unit and second moving unit according to output signals of the slave control sections, and a master control section connected to the printing image allocation setting section and each of the slave control sections via a network.

10 Claims, 10 Drawing Sheets

C : CYAN M : MAGENTA Y : YELLOW B : BLACK

SYNCHRONOUS CONTROL APPARATUS OF A ROTARY PRESS FOR SELECTING A CONTROL TARGET BASED ON PRINTING IMAGE INFORMATION

BACKGROUND OF THE INVENTION

1. Field of the Invention

The present invention relates to a synchronous control apparatus of a rotary press including printing units and other necessary units, and more specifically, it relates to a synchronous control apparatus of a rotary press for selecting a drive control target based on printing image information of each printing couple in a rotary press for printing newspaper provided with a plurality of multicolor printing units as printing units each having a combination of at least two printing sections each provided with two printing couples capable of printing, for example, four pages of newspaper arranged in an axial direction of a plate cylinder so that respective blanket cylinders can contact each other and each printing couple can be individually driven.

2.Description of the Related Art

A rotary press in which each printing mechanism forming a printing section, for example, a printing couple or the like constituted by a plate cylinder and a blanket cylinder is individually driven is disclosed, for example, in Japanese Patent Laid-Open No. 8-85196. This specification describes that a drive motor provided to be able to individually drive each printing mechanism and retracting device are rotated by being controlled in a rotational angle by a computerized motor controller to make it possible to excellently adjust each printing mechanism and retracting device to each other in accordance with the progress of printing and drive them. This specification also discloses that aggregates of a printing machine, including the retracting device, are variably combined.

Further, Japanese Patent Laid-Open No. 5-64882 discloses a rotary press constituted by units being printing mechanisms to be mechanically independent and individually driven, and describes that a drive motor for each unit of this rotary press is subjected to a synchronous phase control by control means. Further, it describes that automatic connection between the units is facilitated.

Japanese Patent Laid-Open No. 6-47905 discloses a rotary printing machine having a plurality of cylinders individually driven and a folding device individually driven by an electric motor, and describes that a master system for operating this rotary press is constituted by an upper master device and an autonomous printing station group separated into a plurality of pieces and assigned to the folding device, which is excellent in flexibility with a simple structure. Further, it also describes that when the printing station group is assigned to the folding device, it can be assigned in any manner.

Japanese Patent Laid-Open No. 10-114058 discloses a synchronous control apparatus for synchronously controlling a plurality of motors so that differences in mutual phases of machine axes of a plurality of machines rotationally driven by a plurality of motors are held in a fixed relationship.

However, the above-described Japanese Patent Laid-Open No. 8-85196 does not disclose means for variably combining the aggregations of the printing machine. Further, Japanese Patent Laid-Open No. 5-64882 does not disclose means for performing automatic connection between the units, and Japanese Patent Laid-Open No. 6-47905 does not disclose means for assigning the printing station group to the folding device. Further, Japanese Patent Laid-Open No. 10-114058 never discloses that the synchronous control apparatus disclosed in this specification specifies or selects a control target.

Incidentally, for example, in newspaper printing, a rotary press in which all printing units are multicolor printing units each with at least two sets of so-called BB printing sections, usually, four sets of them, being stacked in a height direction is used so that multicolor printing surfaces can be placed on all pages, or so that a complicated paper feeder is not required on whichever page the multicolor printing surface may be placed.

However, for various reasons, virtually no newspaper with all of its pages being multicolor printed surfaces is issued. Accordingly, when newspaper is actually printed, it sometimes happens that some of the printing sections are not required to operate, and therefore there arises an increasing request for performing a printing operation while stopping the printing sections having no need to operate, that is, the printing sections that may be stopped, in terms of many points such as energy saving, reduction in running cost, and improvement in operation safety.

However, if an operator specifies the printing sections to be stopped each time, it often happens that the operator fails to specify the printing sections to be specified, and a desired energy saving, reduction in running cost, and improvement in operation safety are sometimes hindered. Though extremely rarely, it happens that the operator specifies the printing sections that are not to be specified, whereby defective printed matters occur and a problem such as a trouble in printing process step occurs, and a delay in operation is caused.

Consequently, a reasonable apparatus capable of correctly and surely specifying the printing sections to be stopped is demanded.

On the other hand, in the above described multicolor printing unit, it goes without saying that supply of ink is not needed in the printing sections that are stopped, but in the printing sections using the blanket cylinders on the other surface sides as the impression cylinders in order to print on only one face of the paper web, the supply of ink is not needed in the printing couples using the blanket cylinders as impression cylinders, either. Therefore, as for the printing couples having no need for supply of ink, a demand for performing a printing operation while stopping ink supply to a printing image on the plate cylinders is increasing, in terms of many points such as energy saving by reduction in drive load, reduction in running cost such as prevention of exhaustion of the inking roller, favorable maintenance of an operation environment by reducing ink mist generation sources, and improvement in operation safety by reducing useless rotationally operating parts.

However, if an operator specifies the printing couples ink supply to which is to be stopped each time, the operator often fails to specify the printing couples to be specified, which sometimes causes troubles in a desired energy saving, reduction in running cost, favorable maintenance of an operation environment, and improvement in operation safety. Though extremely rarely, the operator specifies the printing couples not to be specified, and defective printed matters occur and problems such as a trouble in the printing process step occurs, whereby a delay in operation is caused. Thus, a reasonable apparatus capable of correctly and surely specifying the printing couples ink supply to which is to be stopped is demanded.

SUMMARY OF THE INVENTION

The present invention is made in view of the aforementioned points, and its object is to provide a synchronous control apparatus of a rotary press for selecting a control target based on printing image information, which reduces a failure to specify the printing couples to be specified by previously specifying the printing sections that may be stopped, intends to achieve desired energy saving, reduction in running cost, favorable maintenance of an operation environment and improvement in operation safety, and prevents occurrence of defective printed matters by specifying the printing couples not to be specified, the resultant occurrence of a trouble in the printing process step and causation of a delay in operation.

The present invention is, in a rotary press having a plurality of multicolor printing units to print, constructed to include a printing image allocation setting section 8 for allocating printing images which printing couples print, drive means MO for driving the printing couples, inking transmission means 50, first moving means 90 for moving blanket cylinders BC of two of the printing couples, second moving means 62 for allowing ink supply, slave control sections 2 for controlling rotation of the drive means MO, transmission means related to the printing couples and inking devices 60, operation control sections 100 for controlling operations of the first moving means 90 and second moving means 62 according to output signals of the slave control sections 2, and a master control section 1 connected to the printing image allocation setting section 8 and each of the slave control sections 2 via a network 4.

DETAILED DESCRIPTION OF THE PREFERRED EMBODIMENTS

Figure 1:
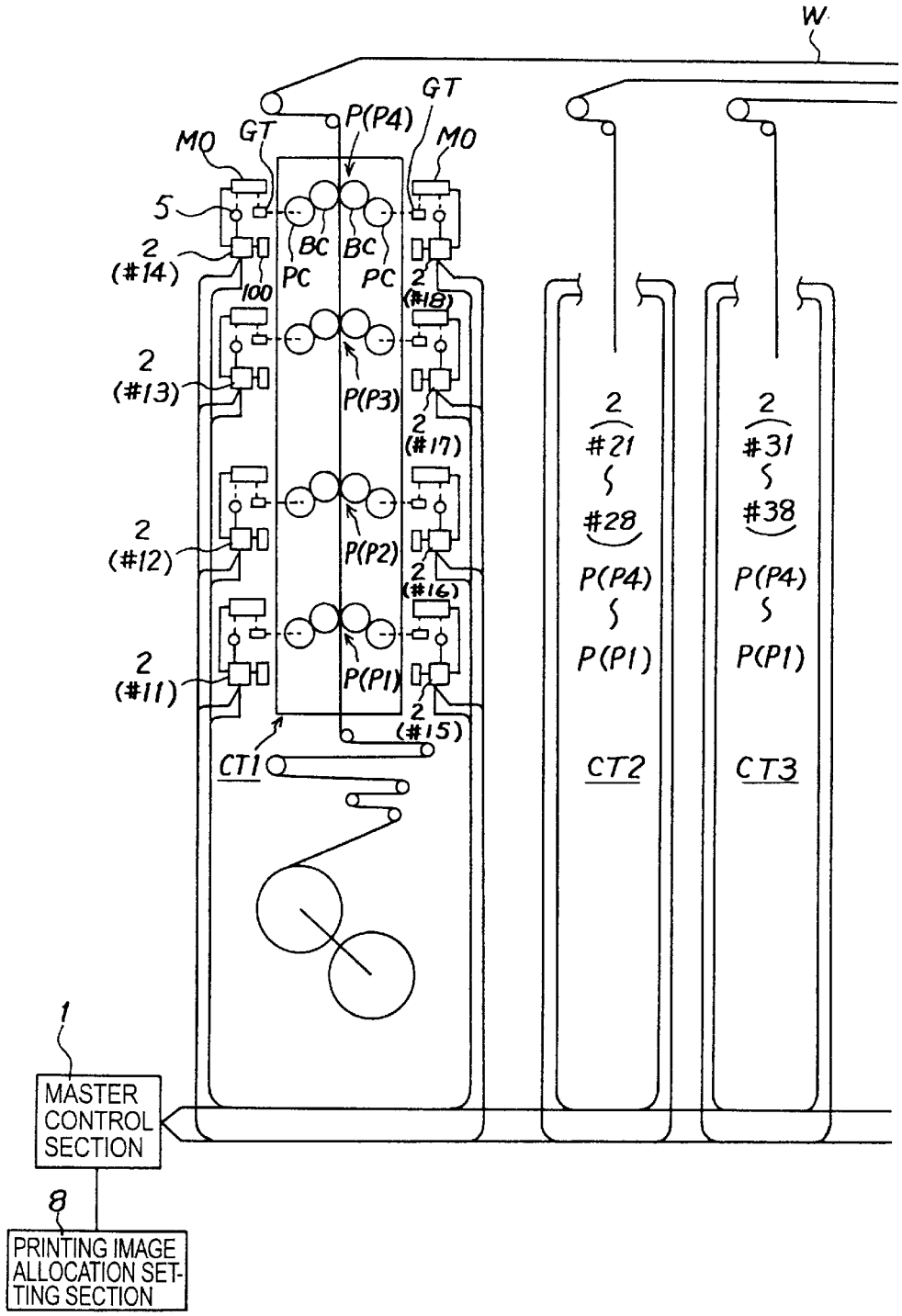
FIG. 1 is a partial view of a schematic block diagram of a rotary press for printing newspaper to which one embodiment of the present invention is applied.

A synchronous control apparatus of a rotary press for selecting a control target based on printing image information of the present invention is, in a rotary press having a plurality of multicolor printing units with a combination of at least two sets of blanket-to-blanket printing sections, and printing with use of a paper web conforming to each printing image area of the multicolor printing units, wherein each of the aforementioned blanket-to-blanket printing sections (BB printing sections) is constructed to include printing couples with a plate cylinder and a blanket cylinder being arranged to be able to contact each other and with the blanket cylinder of the printing couple and a blanket cylinder of another printing couple being provided to be able to contact each other, and an inking device provided for each printing couple, for supplying ink to a printing image on the plate cylinder, and to print the printing image on the plate cylinder onto the paper web passing between the two blanket cylinders via the blanket cylinder, characterized by comprising a printing image allocation setting section for allocating a printing image which each of the printing couples is to print to the printing couple, drive means provided for each printing couple to individually drive each printing couple, inking transmission means connectable to and releasable from the drive means of the printing couples, for transmitting power of the drive means of the printing couples to the inking devices, first moving means provided for each printing couple to move at least the blanket cylinder to a printing position at which the blanket cylinder and the plate cylinder of each printing couple are in contact with each other and the blanket cylinders of the two printing couples forming the BB printing section are in contact with each other, and to a waiting position at which they are not in contact with each other, second moving means provided for each of the inking devices to move at least one predetermined roller of the inking device provided for the printing couple to a position at which ink is supplied to the printing image on the plate cylinder of the printing couple and to a position at which ink is not supplied, a slave control section provided for each drive means, for controlling rotation of the drive means, an operation control section provided for each slave control section, for controlling an operation of transmission means related to the printing couple and the inking device driven by the drive means controlled by the slave control section and operations of the first moving means and the second moving means in accordance with an output signal of the slave control section, and a master control section connected to said printing image allocation setting section and each of the aforementioned slave control sections for transmitting and receiving information via a network, and characterized in that the master control section specifies the slave control sections to be controlled, based on information of the printing image allocation setting section, and transmits a control reference signal to the specified slave control sections, and the slave control sections instruct the operation control sections to output a signal according to the specification of a master signal.

First, information of the printing image to be printed this time, that is, in which position of which printing couple in which multicolor printing unit the image is printed is set in the printing image allocation setting section. This printing image allocation information may be set by selectively specifying it from a number of printing image allocation information patterns previously determined. Alternatively, for example, in the rotary press for printing newspaper, the above information may be automatically set based on input of information necessary for setting printing image allocation information, such as unit specification information specifying the multicolor printing units and folding unit to be used, number of pages information specifying the total number of pages of newspaper to be printed, and printing color information specifying the colors printed on each page.

Subsequently, the suitable master control section is specified, and the printing image allocation information set by the printing image allocation setting section is transmitted to the specified master control section from the printing image allocation setting section.

The master control section selects and specifies the slave control sections for controlling the drive means of the printing couples to be the operation control target in printing this time based on the received printing image allocation information.

Further, the master control section selects the printing couples to be supplied with ink in printing of this time based on the printing image allocation information, and specifies the necessity of ink supply in the printing couple to the slave control sections for controlling the drive means of the printing couples.

The master control section transmits a signal being a control reference to each of the slave control sections specified to be the control target.

Each of the slave control sections specified as the control target by the master control section instructs the operation control section provided correspondingly to the slave control section to bring the blanket cylinder of the printing couple driven by the drive means, which the slave control section controls, into a printable state.

Each of the slave control sections specified as the control target by the master control section and specified as requiring ink supply instructs the operation control section provided correspondingly to the slave control section to bring the inking device provided correspondingly to the printing couple driven by the drive means, which the slave control section controls, into a state in which it is allowed to supply ink.

Further, each of the slave control sections specified as the control target by the master control section, to which the signal being a control reference is transmitted, controls an operation of the drive means, which the slave control section controls, in accordance with the received control reference. Each of the slave control sections that are not specified as the control target and each of the slave control sections that are not specified as requiring ink supply do not give each of the aforementioned instructions. Further, the signal being a control reference is not transmitted to each of the slave control sections that are not specified as the control target from the master control section, and the drive means the control sections control is not actuated.

Figure 2:
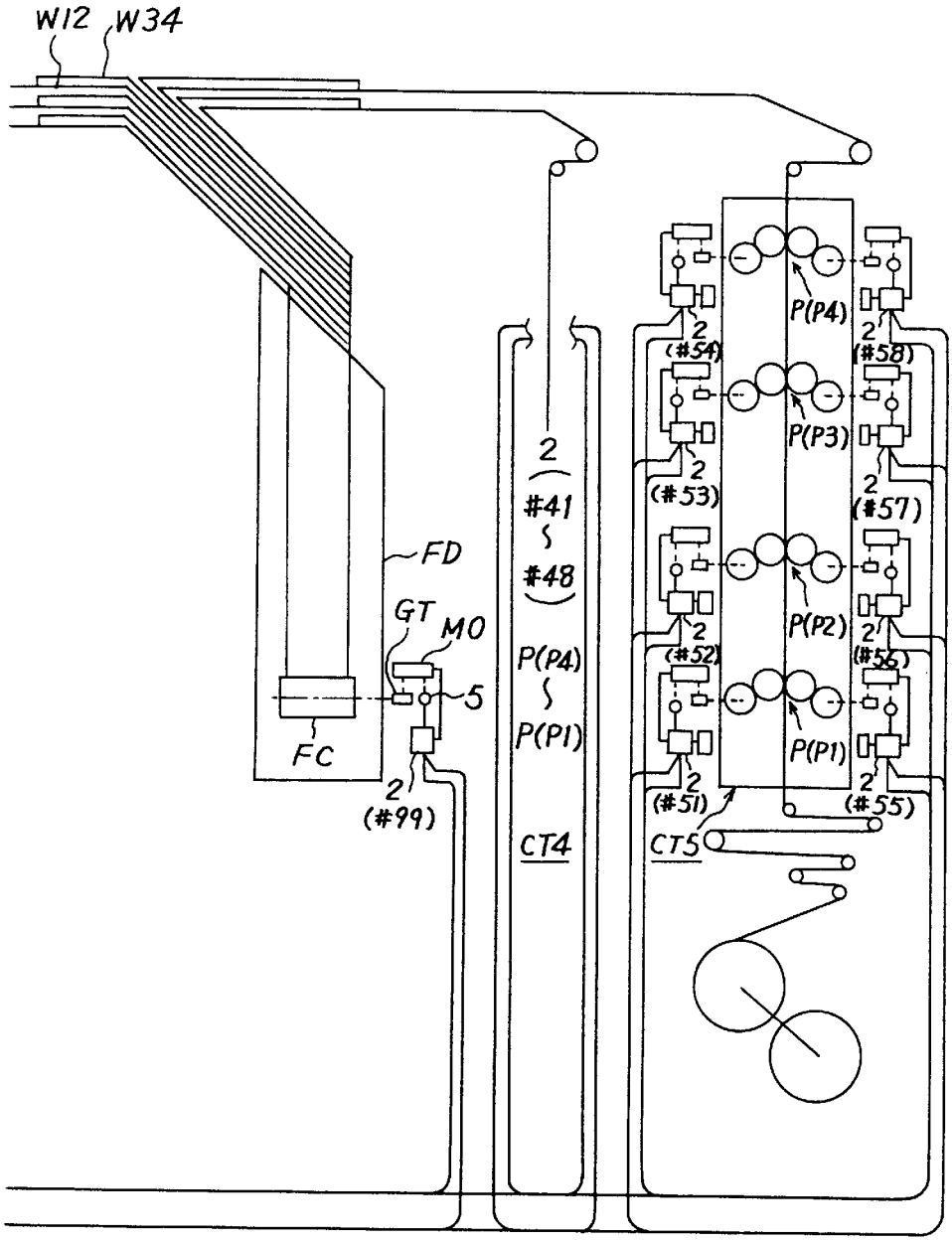
FIG. 2 is a partial view of the schematic block diagram of the rotary press for printing newspaper to which the one embodiment of the present invention is applied, the left end of which is connected to the right end of FIG. 1 to be completed.

FIG. 1 is a partial view of a schematic block diagram of a rotary press for printing newspaper to which one embodiment of the present invention is applied, and FIG. 2 is a partial view of the schematic block diagram of the rotary press for printing newspaper to which the one embodiment of the present invention is applied, the left end of which is connected to the right end of FIG. 1 to complete the schematic block diagram.

In FIG. 1 and FIG. 2, the rotary press includes multicolor printing units CT1 through CT5 each having four printing sections P (P1, P2, P3 and P4), and a folding unit FD for cutting a printed paper web W by each predetermined printed image and folding it. Each of the printing sections P is provided with two sets of printing couples each with a plate cylinder PC and a blanket cylinder BC being arranged to be able to contact each other so that the respective blanket cylinders BC are able to contact each other, and for example, in the case of a rotary press for printing newspaper, the printing couple has such a width as to make it possible to print four pages of newspaper arranged side by side. The paper web W with the entire width of four pages of newspaper having printing thereon is divided at a center of the width, and a divided paper (narrow paper web divided wide paper web) W34 printed on a third area and fourth area (see FIG. 6 and FIG. 7) of printing cylinders of the printing section P (referred to as a printing cylinder when both of the plate cylinder PC and the blanket cylinder BC are given a generic name, or when it is not necessary to specify either one of them, and ditto for hereinafter) is superimposed on a divided paper W12 printed on a first area and a second area (see FIG. 6 and FIG. 7) of the printing cylinders of the printing section P by a turn bar device (not shown). Further, all the divided paper W12 and the divided paper W34 printed in the multicolor printing units CT1 through CT5 are superimposed and guided to the folding unit FD to produce a copy of newspaper.

Figure 6:
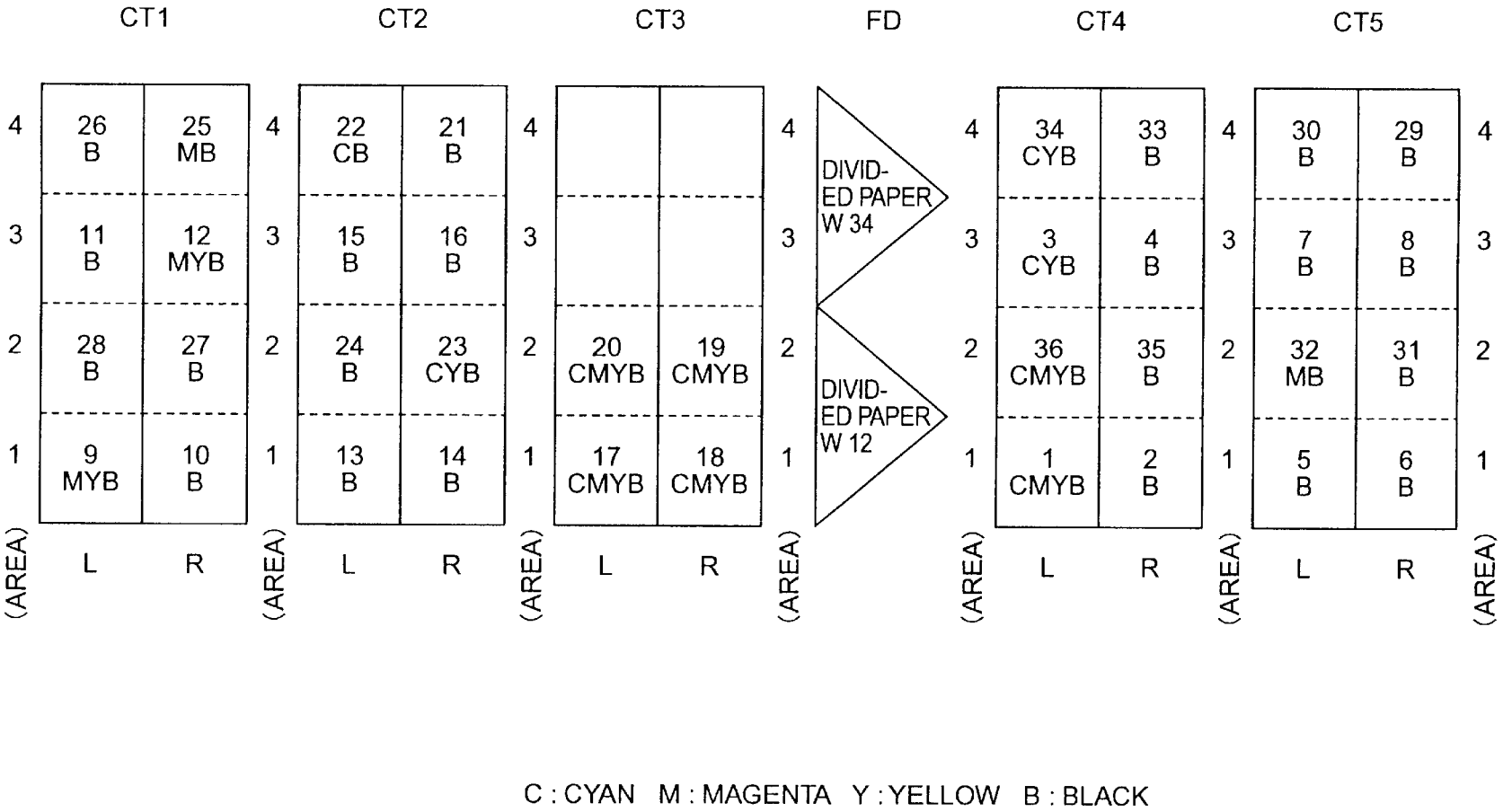
FIG. 6 is a diagram showing printing "pages" allocated to a left side printing cylinder L and a right side printing cylinder R of each multicolor printing unit when newspaper of 36 pages is printed with printing colors of each page as shown in Table 1 by means of a rotary press with five multicolor printing units.

It should be noted that "pages" printed on the third and fourth area of each of the printing cylinders L and R are not allocated in the multicolor printing unit CT3 in the embodiment explained here, as shown in FIG. 6 that will be explained later. Accordingly, in the multicolor printing unit CT3, the paper web W with a width of two pages of newspaper is used and therefore the divided paper W34 is not used.

In each printing couple, the plate cylinder PC is driven by the drive means MO via transmission means GT, and the blanket cylinder BC via the plate cylinder PC and transmission means (not shown) provided between the plate cylinder PC and the blanket cylinder BC. The blanket cylinder BC of each printing section P is connected to first moving means 90 (see FIG. 3) constituted by a blanket cylinder contacting and separating mechanism and a hydropneumatic cylinder so as to be able to contact and separate from the adjacent blanket cylinder BC.

The blanket cylinder contacting and separating mechanism is driven by the hydropneumatic cylinder and allows the blanket cylinder BC to move between a position (printing position) at which the blanket cylinder BC is in contact with the plate cylinder PC correspondingly provided and the adjacent blanket cylinders BC are in contact with each other and a position (waiting position) at which at least the adjacent blanket cylinders BC separate from each other.

In the folding unit FD, a folding cylinder FC is driven by the drive means MO via the transmission means GT, and another cylinder is driven via the transmission means not shown and provided between the folding cylinder FC and the other cylinder. It should be noted that it may be the structure in which an output shaft of the drive means MO directly drives the plate cylinder PC or the folding cylinder FC, with the transmission means GT existing between the drive means MO and the plate cylinder PC or the folding cylinder FC being removed.

Figure 3:
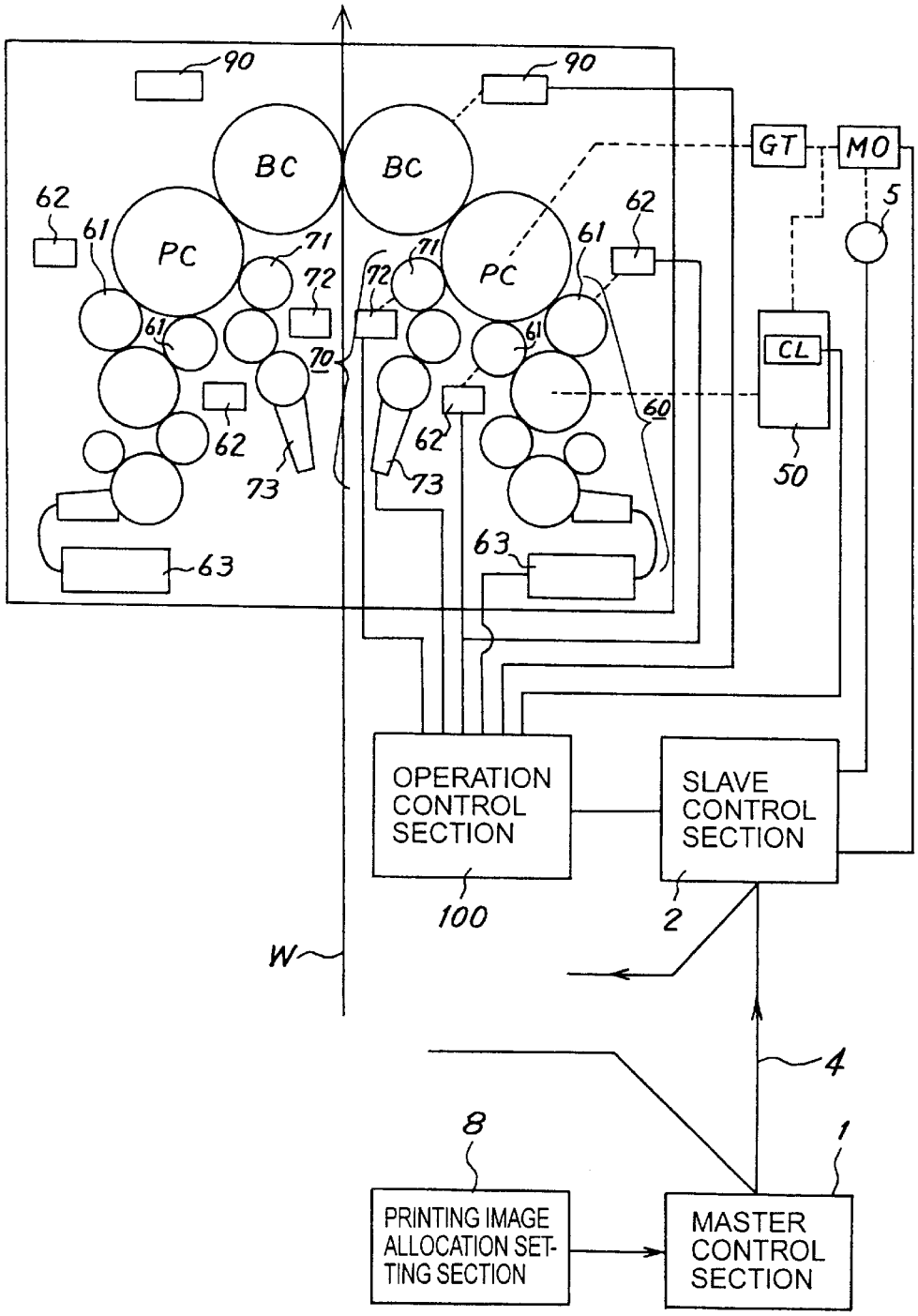
FIG. 3 is a schematic block diagram of printing couples to which the one embodiment of the present invention is applied.

As shown in FIG. 3, each of the printing couples has an inking device 60 and a dampening device 70.

The inking device 60 and the dampening device 70 are connected to inking transmission means 50 having a power coupling mechanism CL being, for example, a clutch, and the inking transmission means 50 is provided to be connectable to and releasable from the drive means MO of the aforementioned printing couple by the power coupling mechanism CL. Inking rollers 61 and 61 of the inking device 60 are connected to second moving means 62 constituted by an inking roller contacting and separating mechanism and a hydropneumatic cylinder so that each of them is able to contact and separate from a printing plate surface of the plate cylinder PC. The inking roller contacting and separating mechanism is driven by the hydropneumatic cylinder to move the inking rollers 61 to and from a position at which they are in contact with the printing plate surface of the plate cylinder PC (the position at which ink is supplied to a printing image) from and to a position at which they are separated from the printing plate surface of the plate cylinder PC.

Similarly, a dampening roller 71 of the dampening device 70 is connected to third moving means 72 constituted by a dampening roller contacting and separating mechanism and a hydropneumatic cylinder so that it is able to contact and separate from the printing plate surface of the plate cylinder PC. The dampening roller contacting and separating mechanism is driven by the hydropneumatic cylinder to move the dampening roller 71 to and from a position in contact with the printing plate surface of the plate cylinder PC (the position at which dampening water is supplied to the printing plate surface) from and to a position separated from the printing plate surface of the plate cylinder PC.

Further, the inking device 60 is provided with an ink pump group 63 driven by a stepping motor or the like, and the dampening device 70 is provided with a dampening water injection nozzle group 73 of which injection port is opened and closed, for example, by solenoid.

The drive means MO of the aforementioned printing couples and the drive means MO of the folding unit FD are provided with slave control sections 2 of #11 to #18, #21 to #28, #31 to #38, #41 to #48, #51 to #58 and #99 and rotary encoders (hereinafter, called "encoder") 5 with a Z phase for outputting a pulse signal for each angular displacement at a predetermined angle and outputting a Z phase pulse signal for each rotation, each of which corresponds to each of the drive means MO. The slave control sections 2 are connected to a network line 4 via a slave network connecting section 21 explained in FIG. 5. An operation control section 100 that will be explained later is provided correspondingly to each slave control section 2.

A master control section 1 is also connected to the network line 4. Instead of the master control section 1, a plurality of master control sections may be provided, each of which has the function of the master control section 1 that will be explained later, and the master control sections can be selectively switched to be used.

The network line 4 is formed in a loop shape, and it is constructed to be able to transmit a signal between the master control section 1 and the slave control sections 2 of #11 to #18, #21 to #28, #31 to #38, #41 to #48, #51 to #58, and #99 in the other direction even if blockage occurs in one direction.

Figure 4:
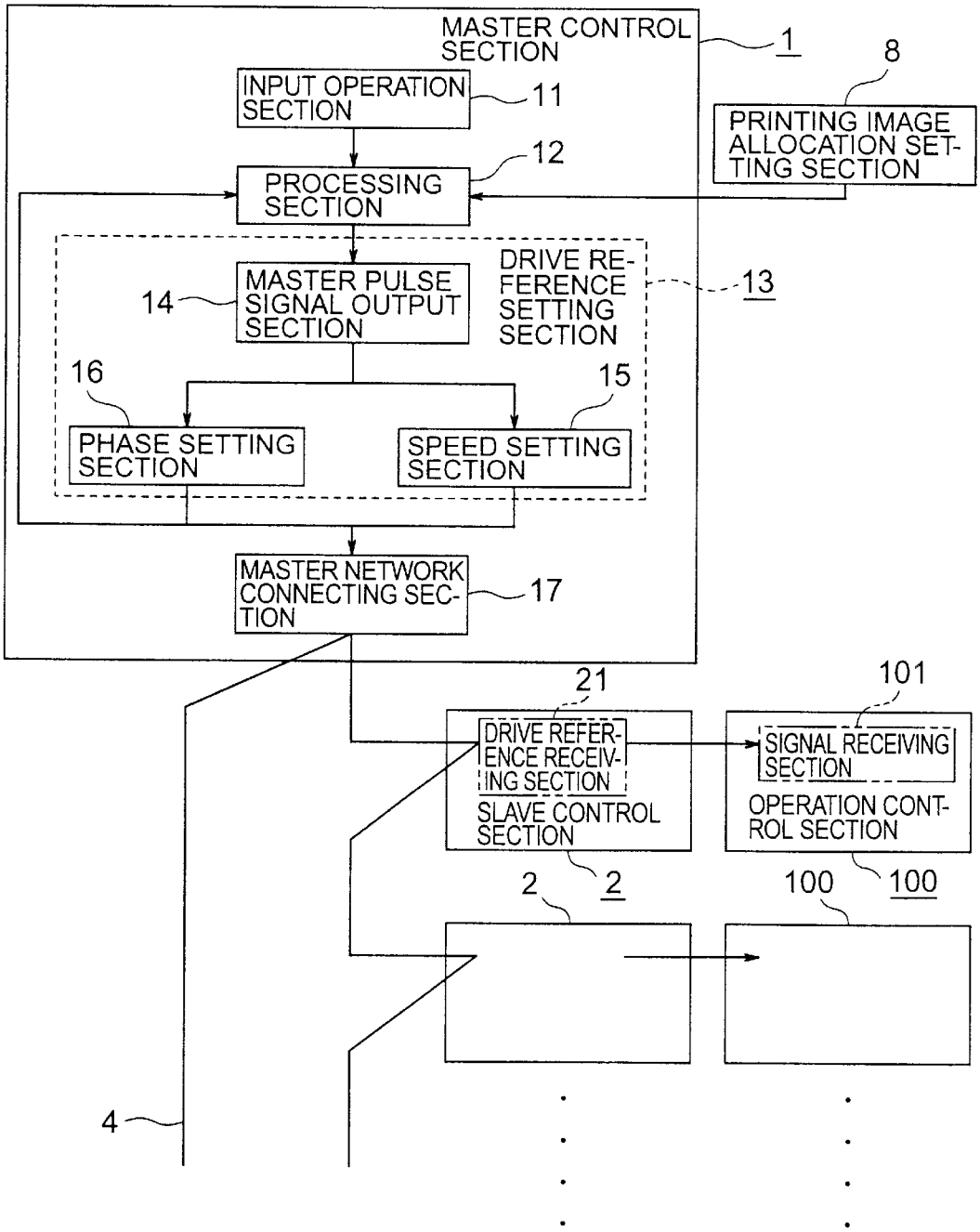
FIG. 4 is a block diagram of a master control section of the one embodiment.

FIG. 4 is a block diagram of a master control section of the one embodiment.

In FIG. 4, the master control section 1 includes an input operation section 11, a drive reference setting section 13, a processing section 12, and a master network connecting section 17. The master control section 1 is connected to a printing image allocation setting section 8.

The input operation section 11 is designed to make it possible to perform an operation control to input operation signals of at least actuation, acceleration and deceleration, stop and the like.

The processing section 12 receives allocation information from the printing image allocation setting section 8, organizes the set of the rotary presses for printing operation of this time to create control range specification electronic document, based on the allocation information, and can perform operation control from the aforementioned input operation section 11 so as to be able to perform synchronous control of the organized set and also perform drive reference setting based on the operation.

The processing section 12 selects the printing couples requiring operation of the inking device 60 and the dampening device 70 in each of the multicolor printing units CT1 through CT5, based on the aforementioned allocation information, and specifies them by the aforementioned control specification electronic document.

The master network connecting section 17 transmits the control range specification electronic document created by the processing section 12 to the network line 4, also transmits a control electronic document related to a drive reference value and the like set by the drive reference setting section 13 that will be explained later to the network line 4, and receives response electronic documents being response information transmitted from the slave control sections 2 via the network line 4.

The aforementioned drive reference setting section 13 has a master pulse signal output section 14, a speed setting section 15, and a phase setting section 16.

The master pulse signal output section 14 outputs a first master pulse signal proportional to a speed value set by the processing section 12 based on the operation signals of actuation, acceleration and deceleration, stop and the like input by the input operation section 11, and outputs a second master pulse signal each time a predetermined number of first master pulse signals are outputted. The first master pulse signal and the second master pulse signal are signals of frequency equal to those of a pulse signal outputted by the encoder 5 provided correspondingly to each drive means MO and the Z phase pulse signal outputted by the encoder 5, when the multicolor printing unit is operated at a set speed.

The speed setting section 15 sets the drive reference speed of the drive means MO based on the first master pulse signal, which the master pulse signal output section 14 outputs.

The phase setting section 16 sets the drive reference phase of the printing cylinder, for example, the plate cylinder PC, driven by the drive means MO, based on the first master pulse signal and the second master pulse signal, which the master pulse signal output section 14 outputs.

Figure 5:
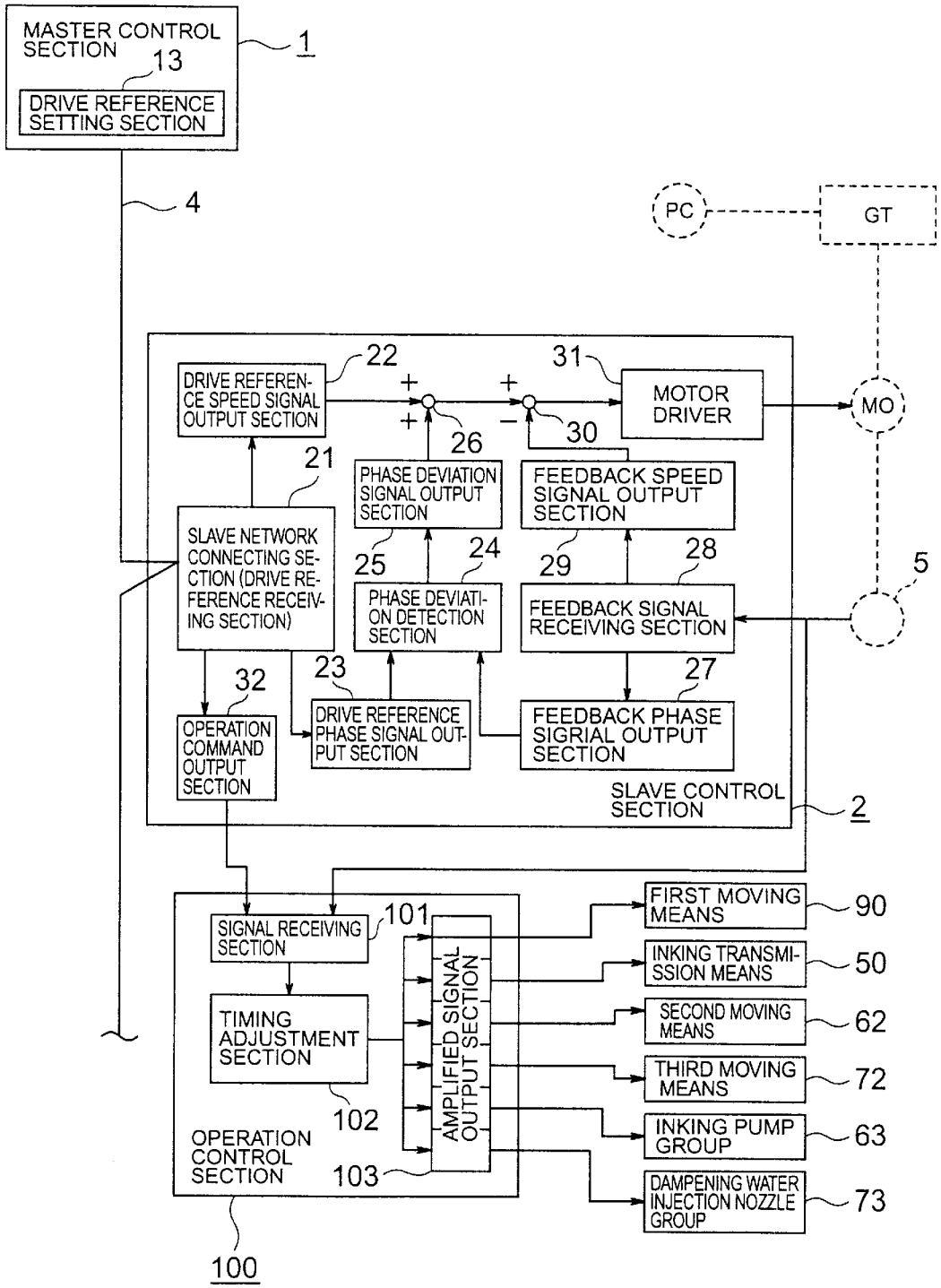
FIG. 5 is a block diagram of a slave control section and an operation control section of the one embodiment.

FIG. 5 is a block diagram of the slave control section and the operation control section of the one embodiment. It should be noted that the operation control section 100 is not provided correspondingly to the slave control section 2 of #99 for controlling the drive means MO of the folding cylinder FC of the folding unit FD.

In FIG. 5, the slave control section 2 has the slave network connecting section 21 also serving as a drive reference receiving section, a drive reference speed signal output section 22, a drive reference phase signal output section 23, a feedback signal receiving section 28, a feedback speed signal output section 29, a feedback phase signal output section 27, a phase deviation detecting section 24, a phase deviation signal output section 25, a first speed signal correction section 26, a second speed signal correction section 30, a motor driver 31 and an operation command output section 32.

The slave network connecting section 21 is a microcomputer including an interface, which receives a control range specification electronic document composed of a set organization information transmitted by the master control section 1 and a control electronic document such as a drive reference being a drive reference speed and a drive reference phase via the network line 4, and transmits a response electronic document reporting the receipt of the electronic document from the master control section 1 to the master control section 1 via the network line 4 as necessary. When the received control range specification electronic document instructs a synchronous drive control of the drive of the printing couple by the slave control section 2, it is judged whether or not the operation of the inking device 60 and the dampening device 70 is specified, and a signal based on the judgement result is outputted to the operation command output section 32.

The drive reference speed signal output section 22 converts the drive reference speed of the control electronic document into a drive reference speed signal of an analogue signal proportional to the speed value set by the aforementioned processing section 12 based on an input signal inputted from the aforementioned input operation section 11 and outputs it.

The drive reference phase of the control electronic document is inputted into the drive reference phase signal output section 23. Each time a drive reference phase is inputted, the drive reference phase signal output section 23 performs correction of phase by a predetermined amount so that the printing image printed by the printing couple is in a correct relationship with a cutting position by the folding unit FD, based on a length of a paper feeding route from each printing couple to a position of cutting action of the folding unit FD and an assembly phase of the plate cylinder PC of the printing couple and the encoder 5 via the drive means MO, and outputs the corrected phase in a proper signal as a drive reference phase.

The drive reference phase signal output section 23 of the slave control section 2 of #99 for controlling the drive means MO of the folding cylinder FC of the folding unit FD outputs an inputted drive reference phase in a proper signal as a drive reference phase.

The pulse signal and Z phase pulse signal outputted by the encoder 5 corresponding to the drive means MO are inputted to the feedback signal receiving section 28. The feedback speed signal output section 29 computes a value proportional to the rotational speed of the drive means MO based on the pulse signal outputted by the encoder 5, further converts it into the drive speed signal being an analogue signal proportional to the rotational speed of the drive means MO and outputs it.

The feedback phase signal output section 27 detects a rotational phase of the printing cylinder being a driven part, for example, the plate cylinder PC, from the pulse signal outputted by the encoder 5, and outputs it in a proper signal.

The phase deviation detection section 24 detects a deviation of the phase of the printing cylinder with respect to the drive reference phase, from the drive reference phase signal outputted by the drive reference phase signal output section 23 and the phase signal of the printing cylinder (for example, the plate cylinder PC) outputted by the feedback phase signal output section 27.

The phase deviation signal output section 25 is a proportional-plus-integral amplifier, which converts the deviation detected by the phase deviation detection section 24 into a phase deviation signal being an analogue signal and outputs it.

The first speed signal correction section 26 corrects the drive reference speed signal outputted by the drive reference speed signal output section 22 in accordance with the phase deviation signal outputted by the phase deviation signal output section 25.

The second speed signal correction section 30 corrects the first correction speed signal after corrected by the first speed signal correction section 26 in accordance with the drive speed signal of the drive means MO outputted by the feedback speed signal output section 29.

The motor driver 31 supplies a drive electric power to the drive means MO, which the motor driver 31 itself controls, based on the second correction speed signal after corrected by the second speed signal correction section 30.

On receiving the signal from the slave network connecting section 21, the operation command output section 32 outputs an operation command signal to the operation control section 100 so as to move the blanket cylinder BC of the printing couple controlled to be synchronously driven by the slave control section 2 to be able to perform a printing operation, and to enable the inking device 60 and the dampening device 70 provided at the printing couple to perform a printing operation as necessary.

The operation control section 100 has a signal receiving section 101, a timing adjustment section 102 and an amplified signal output section 103.

The signal receiving section 101 is an interface for receiving the operation command signal outputted by the operation command output section 32 of the aforementioned slave control section 2 and the output signal of the aforementioned encoder 5, and it transmits the received operation command signal and output signal of the encoder 5 to the timing adjustment section 102.

The timing adjustment section 102 is constituted by, for example, a microcomputer, and outputs only an operation signal of the first moving means 90 in a timing previously set when the signal transmitted from the signal receiving section 101 is a signal having a code "D" for instructing to only move the blanket cylinder BC of the printing couple so as to be able to perform a printing operation. When the signal transmitted from the signal receiving section 101 is a signal having a code "I" for instructing to move the blanket cylinder BC of the printing couple so as to be able to perform a printing operation and enable the inking device 60 and the dampening device 70 to perform a printing operation, the timing adjustment section 102 outputs each operation signal for the first moving means 90, the inking transmission means 50, the second moving means 62, the third moving means 72, the inking pump group 63, and the dampening water injection nozzle group 73 in a timing previously set. The timing adjustment section 102 also detects the operation speed of the printing couple based on the output signal of the encoder 5 and refers to this speed, when adjusting the output timing of the operation signal.

Next, an operation of the synchronous control apparatus of the rotary press according to the present invention will be explained with the case in which it is carried out in a rotary press for printing newspaper capable of printing a printing image of four pages of newspaper arranged in an axial direction of the plate cylinder PC as an example.

Prior to the printing operation of the rotary press, the information of the printing image printed this time, that is, the information regarding in which area of which printing couple of which multicolor printing unit the images are printed is set in the printing image allocation setting section 8.

As for the setting of the printing image allocation information, for example, when the newspaper with the total number of pages of 36 and printing colors on each page being as shown in Table 1 is printed by specifying the multicolor printing units CT1 through CT5, "unit specification information" specifying the multicolor printing units "CT1", "CT2", "CT3", "CT4", and "CT5" being the specified target and the folding unit "FD" being the specified target, and "the number of pages information" specifying the total number of pages "36" of the newspaper to be printed, and "printing color information" specifying the colors printed on each page are inputted to the printing image allocation setting section 8.

The "printing color information" is inputted, for example as "1CMYB: 2B: 3CYB: 4B : 5B: . . . : 36CMYB" when each page is printed with the printing colors as shown in Table 1. The numerals of the printing color formation represent the page numbers, the alphabets represent printing colors, C represents cyan, M magenta, Y yellow, and B black.

TABLE 1

| Page number | Printing color |
|---|---|
| 1 | Cyan |
| | Magenta |
| | Yellow |
| | Black |
| 2 | Black |
| 3 | Cyan |
| | Yellow |
| | Black |
| 4 | Black |
| 5 | Black |
| 6 | Black |
| 7 | Black |
| 8 | Black |
| 9 | Magenta |
| | Yellow |
| | Black |
| 10 | Black |
| 11 | Black |
| 12 | Magenta |
| | Yellow |
| | Black |
| 13 | Black |
| 14 | Black |
| 15 | Black |
| 16 | Black |
| 17 | Cyan |
| | Magenta |
| | Yellow |
| | Black |
| 18 | Cyan |
| | Magenta |
| | Yellow |
| | Black |
| 19 | Cyan |
| | Magenta |
| | Yellow |
| | Black |
| 20 | Cyan |
| | Magenta |
| | Yellow |
| | Black |
| 21 | Black |
| 22 | Cyan |
| | Black |

TABLE 1-continued

| Page number | Printing color |
|---|---|
| 23 | Cyan |
| | Yellow |
| | Black |
| 24 | Black |
| 25 | Magenta |
| | Black |
| 26 | Black |
| 27 | Black |
| 28 | Black |
| 29 | Black |
| 30 | Black |
| 31 | Black |
| 32 | Magenta |
| | Black |
| 33 | Black |
| 34 | Cyan |
| | Yellow |
| | Black |
| 35 | Black |
| 36 | Cyan |
| | Magenta |
| | Yellow |
| | Black |

The printing image allocation setting section 8 allocates the "page" to each of the areas 1 through 4 in axial directions of a left side printing cylinder L and a right side printing cylinder R of each of the specified multicolor printing units CT1 through CT5, based on each of the input information as shown in FIG. 6.

Figure 7:
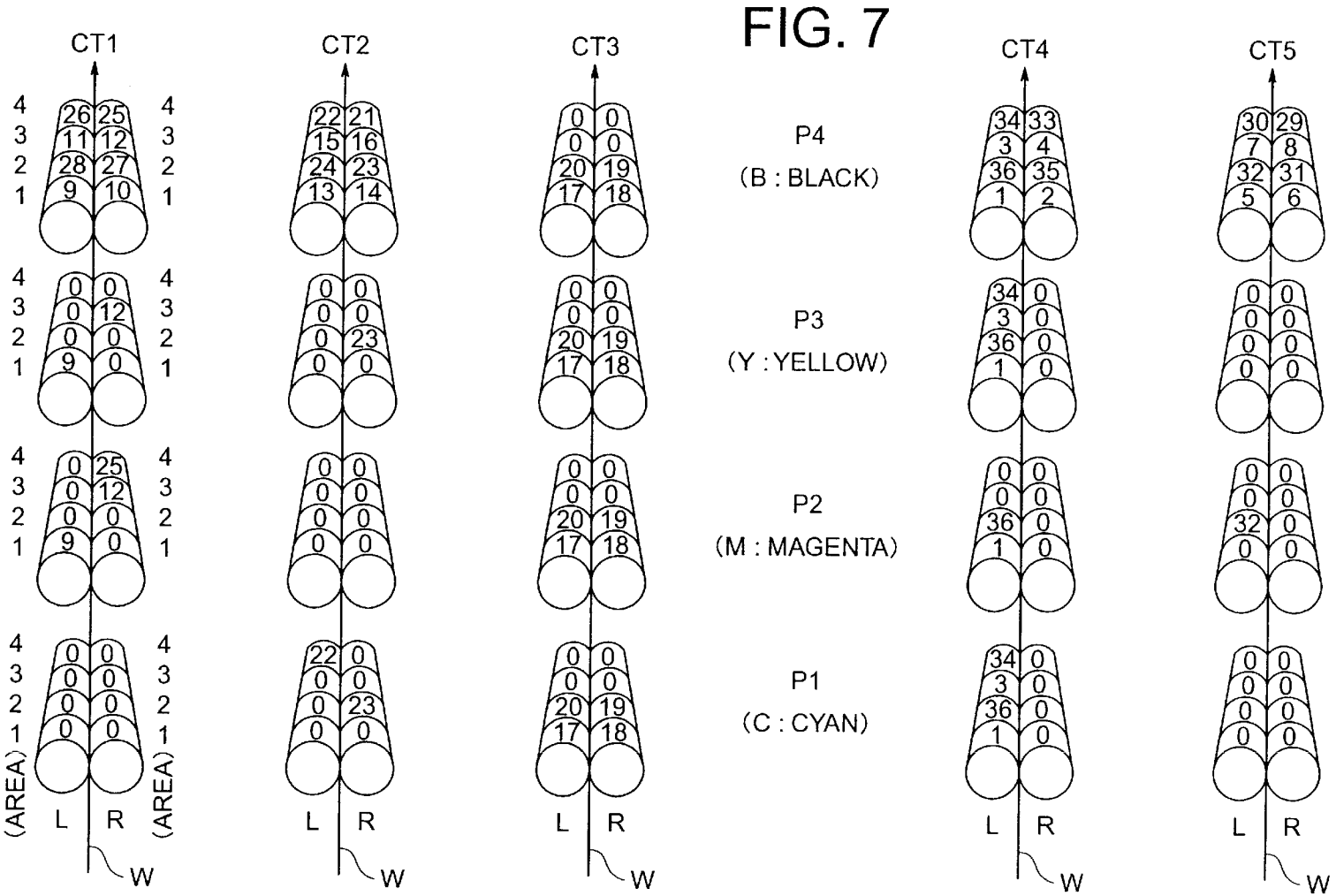
FIG. 7 is a diagram showing the printing "pages" allocated to the five multicolor printing units as shown in FIG. 6 are developed and allocated to a first area through a fourth area of both printing cylinders of each printing section in accordance with printing color specification.

Subsequently, the printing image allocation setting section 8 allocates the image to be printed to each of the printing couples of the specified multicolor printing units CT1, CT2, CT3, CT4, and CT5, for example, as shown in FIG. 7. Each of the multicolor printing units CT1 through CT5 shown in FIG. 7 is arranged so as to be printable in the order of cyan, magenta, yellow and black from an upstream side in a feeding direction (shown by the arrow) of the paper web W. "0" shown in a first area of the left side printing cylinder L of the printing couple of a cyan printing section P1 of the multicolor printing unit CT1 shows that no image is to be printed therein, and "29" shown in a fourth area of the right side printing cylinder R of the printing couple of a black printing section P4 of the multicolor printing unit CT5 shows that an image of the page 29 is to be printed therein.

As for setting of the printing image allocation information, it may be suitable to previously set, for example, the printing image allocation pattern as shown in FIG. 6 or FIG. 7 in the printing image allocation setting section 8, and to selectively specify and set an allocation pattern suitable for the printing operation at each time of the printing operation.

After the setting of the printing image allocation information is completed, the master control section 1 for synchronously controlling each of the drive means MO necessary for the printing operation is designated, and the printing image allocation information set in the printing image allocation setting section 8 is transmitted to the specified master control section 1 from the printing image allocation setting section 8.

The printing image allocation information shown in FIG. 7 is transmitted, for example, as "CT1P1L. 0. 0. 0. 0. R. 0. 0. 0. 0: CT1P2L. 9. 0. 0. 0. R. 0. 0. 12. 25: CT1P3L. 9. 0. 0. 0. R. 0. 0. 12. 0: CT1P4L. 9. 28. 11. 26. R. 10. 27. 12. 25: . . . : CT5P4L. 5. 32. 7. 30. R. 6. 31. 8. 29".

The master control section 1, which receives the printing image allocation information, selects and specifies the slave control sections 2 for controlling the drive means MO of the printing couples that is to be the synchronous drive control target in this printing operation, based on the printing image allocation information.

Specifically, the processing section 12 of the master control section 1 checks the presence or absence of the image the printing section P is to print, for each printing section P from the received printing image allocation information. Subsequently, it selects the slave control sections 2 and 2 for individually controlling the drive means MO of the two printing couples forming the printing section P having the image that it is to print as a specified operation target.

When receiving the printing image allocation information shown in FIG. 7, the processing section 12 obtains the sum of the "numeral" shown in each area in the axial direction of each of the printing cylinders of the two printing couples forming the printing section P at each printing section P, and selects the slave control sections 2 and 2 for individually controlling the drive means MO of the two printing couples forming the printing section P of which obtained value is not "0" as the specified operation target. It selects the slave control sections 2 and 2 for individually controlling the drive means MO of the two printing couples forming the printing section P of which sum of the aforementioned "numerals" is "0" as a specified non-operation target.

Incidentally, when receiving the printing image allocation information shown in FIG. 7, the processing section 12 selects the slave control sections 2 of #11, #15, #22, #26, #51, #53, #55, and #57 (see FIG. 1 and FIG. 2) for controlling the drive means MO of the printing couples forming the cyan printing section P1 of the multicolor printing unit CT1, a magenta printing section P2 of the multicolor printing unit CT2, the cyan printing section P1 and a yellow printing section P3 of the multicolor printing unit CT5 as the specified non-operation target, and selects the slave control sections 2 except for them as the specified operation target.

The master control section 1 selects the printing couples requiring the operation of the inking device 60 and the dampening device 70 out of the printing couples to be the synchronous drive control target in this printing operation based on the printing image allocation information, and specifies the choice of operation of the inking device 60 and the dampening device 70 to the slave control sections 2 for controlling the drive means MO of the printing couples.

Specifically, the processing section 12 of the master control section 1 checks the presence or absence of the image which the printing couple is to print for each of the printing couples from the received printing image allocation information. Subsequently, it specifies the choice of operation of the inking device 60 and the dampening device 70 to the slave control sections 2 for controlling the drive means MO of the printing couples having the images which they are to print.

When receiving the printing image allocation information shown in FIG. 7, the processing section 12 obtains the sum of "numeral" shown in each area in the axial direction of the printing cylinders of each printing couple for each printing couple, and specifies the choice of operation of the inking device 60 and the dampening device 70 to the slave control sections 2 for controlling the drive means MO of the printing couples of which obtained values are not "0". It also specifies the choice of non-operation of the inking device 60 and the dampening device 70 to the slave control sections 2 for controlling the drive means MO of the printing couples of which sums of the aforementioned "numerals" are "0".

After the above operation is completed, the master control section 1 is made to specify the control target. Based thereon, the processing section 12 of the master control section 1 creates a control range specification electronic document constituted by ASCII codes, and transmits the control range specification electronic document to each of the slave control sections 2 via the master network connecting section 17 and the network line 4.

Figure 8:
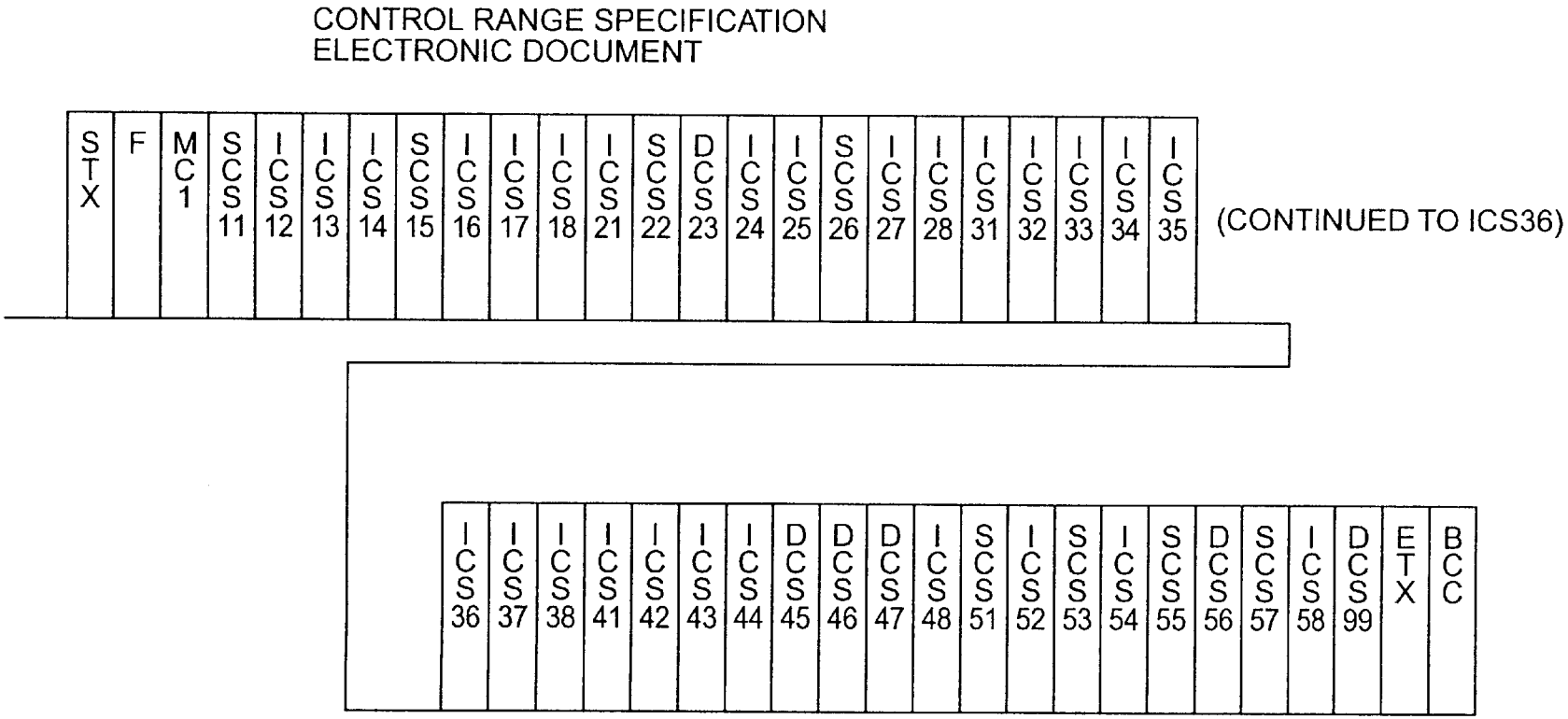
FIG. 8 is a block diagram of a control range specification electronic document of the one embodiment, which the master control section transmits.

As shown in FIG. 8, the control range specification electronic document is a text document in which "F" indicating that this electronic document specifies the control range, "MC1" representing the master control section 1 being the sender of the electronic document and node numbers representing the slave control sections 2 of #11, #12, #13, #14, #15, #16, #17, #18, #21, #22, #23, #24, #25, #26, #27, #28, #31, #32, #33, #34, #35, #36, #37, #38, #41, #42, #43, #44, #45, #46, #47, #48, #51, #52, #53, #54, #55, #56, #57, #58, and #99 of the drive means MO of the printing couples being the control range, that is, the control target, and slave control section selection codes "SCS11" through "ICS58" and "DCS99" constituted by codes "I", "D", and "S" showing whether each slave control section 2 is the specified operation target or the specified non-operation target, and whether the choice of operation or non-operation of the inking device 60 and the dampening device 70 of the printing couple is specified when the slave control section 2 is the specified operation target are inserted between a start code "STX" of the electronic document and a final code "ETX" of the electronic document, and the control range specification electronic document is constituted with a block check "BCC" being attached to this text document.

Incidentally, the aforementioned code "I" means that the printing couple is the specified operation target and the choice of operation of inking device 60 and the dampening device 70 of the printing couple is specified. The "D" means that the printing couple is the specified operation target, but the choice of non-operation of the inking device 60 and the dampening device 70 of the printing couple is specified. The "S" means that the printing couple is the specified non-operation target.

Figure 9:
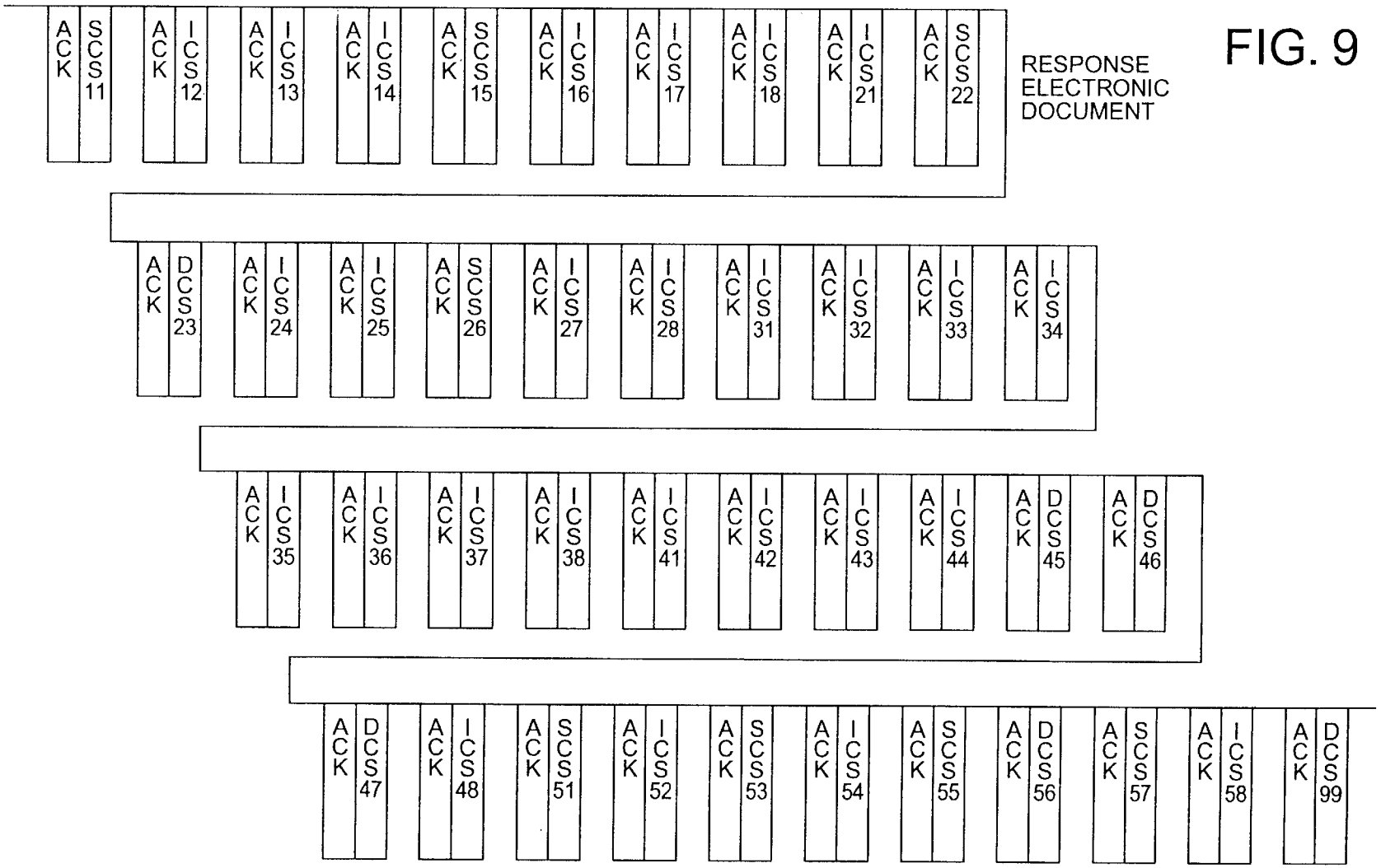
FIG. 9 is a block diagram of a response electronic document of the one embodiment of a slave control section to the control range specification electronic document in FIG. 8.

Each of the slave control sections 2, which receives the control range specification electronic document, transmits the response electronic document reporting that each slave network connecting section 21 receives the control range specification electronic document to the master control section 1 via the network line 4. The response electronic document is composed by "ACK" representing a response electronic document, its own node number representing the responding slave control section 2, and slave control section response codes constituted by the codes "I", "D", and "S" showing whether each slave control section 2 is the specified operation target or the specified non-operation target, and whether the choice of operation or non-operation of the inking device 60 and the dampening device 70 of the printing couple is specified when the slave control section 2 is the specified operation target (see FIG. 9).

When each of the slave control sections 2, which receives the control range specification electronic document, is the specified operation target, it outputs a different signal to the operation control section 100 via the operation command output section 32 depending on whether the choice of operation or the choice of non-operation of the inking device 60 and the dampening device 70 of the printing couple, which the slave control section 2 controls to synchronously drive, is specified.

In the operation control section 100, which receives the signal, the timing adjustment section 102 is in an actuated state corresponding to the received signal. More specifically, when the choice of operation of the inking device 60 and the dampening device 70 is specified, the timing adjustment section 102 outputs a signal to connect the inking transmission means 50 to the drive means MO for driving the printing couple via the power coupling mechanism CL, and is in an actuated state capable of timing adjustment for the output of the operation signal to the first moving means 90, the second moving means 62, the third moving means 72, the inking pump group 63, and the dampening water injection nozzle group 73. When the choice of non-operation of the inking device 60 and the dampening device 70 is specified, the timing adjustment section 102 outputs a signal to release the inking transmission means 50 from the drive means MO for driving the printing couple by the power coupling mechanism CL, and is in an actuated state capable of timing adjustment only for the output of the operation signal to the first moving means 90.

After the above setting is completed, the rotary press is capable of printing operation in which each drive means MO specified to be in the control range is synchronously controlled by the master control section 1.

The printing operation by the synchronous control is performed by inputting the operation signals such as actuation, acceleration and deceleration, stop and so on from the input operation section 11 of the master control section 1 first of all.

On start of the printing operation, when an operation signal of actuation or acceleration is inputted, the processing section 12 sets the speed value corresponding to the input operation signal in the master pulse signal output section 14 of the drive reference setting section 13. Thereby, the master pulse signal output section 14 outputs the first master pulse signal corresponding to the set speed, and outputs the second master pulse signal for each output of a predetermined number of the first master pulse signals.

The first master pulse signal and the second master pulse signal are signals of the frequencies equal to those of the pulse signal outputted by the encoder 5 provided correspondingly to the drive means MO of each printing couple and the Z phase pulse signal outputted by this encoder 5 when the rotary press is operated at a set speed.

When the master pulse signal output section 14 starts to output the aforementioned signal, the speed setting section 15 and the phase setting section 16 of the drive reference setting section 13 calculate the sum of the pulse output which the master pulse signal output section 14 outputs. That is, the speed setting section 15 calculates the sum of the aforementioned first master pulse signals and the calculated value is cleared by the second master pulse signal.

The phase setting section 16 calculates the sum of the first master pulse signals and the second master pulse signals, and the calculated value of the first master pulse signal is cleared by the second master pulse signal, while the calculated value of the second master pulse signal is cleared each time the calculated value reaches a predetermined number.

The predetermined number of the calculated value at which the second master pulse signal is cleared is previously determined based on the ratio of the rotational speed of the driven part (for example, the plate cylinder PC) to the rotational speed of the encoder 5. Thus, for example, when the encoder 5 makes four rotations while the driven part makes one rotation, the aforementioned predetermined number is "four", and when the encoder 5 makes one rotation while the driven part makes one rotation, the aforementioned predetermined number is "one". In other words, in the latter case, the phase setting section 16 does not necessarily have to calculate the sum of the second master pulse signals.

The value of the calculated sums of the aforementioned speed setting section 15 and the phase setting section 16 is transmitted via the network line 4 to the slave control sections 2 being the specified operation target as the control electronic document from the master network connecting section 17 at each predetermined time, for example, every 100 microseconds.

Figure 10:
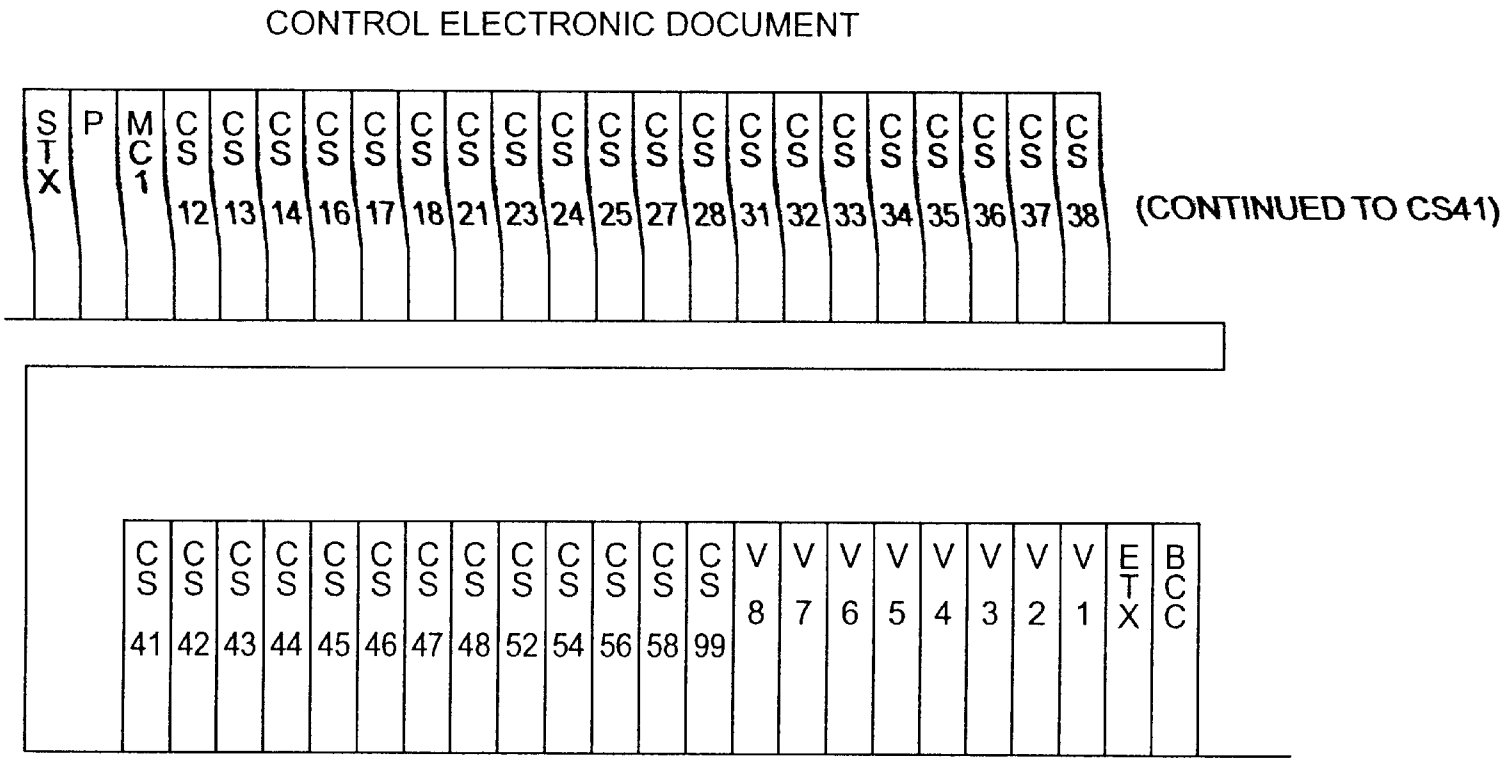
FIG. 10 is a block diagram of a control electronic document of the one embodiment of a printing operation, which the master control section transmits.

As shown in, for example, FIG. 10, the control electronic document is a text document in which "P" indicating that this electronic document is a drive reference, "MC1" representing the controlling master control section 1, "CS12" through "CS58" and "CS99" representing the node numbers of the slave control sections 2 of #12, #13, #14, #16, #17, #18, #21, #23, #24, #25, #27, #28, #31, #32, #33, #34, #35, #36, #37, #38, #41, #42, #43, #44, #45, #46, #47, #48, #52, #54, #56, #58, and #99 of the drive means MO of the printing couples of the multicolor printing units CT1, CT2, CT3, CT4, and CT5 being the specified operation target and the drive means MO of the folding unit FD, "V8" through "V5" representing the drive reference speed, and "V4" through "V1" representing the drive reference phase are inserted between the start code "STX" of the electronic document and the final code "ETX" of the electronic document, and is composed with the block check "BCC" being attached to the text document. Here, "0" to "9" and "A" to "F" of the ASCII code are used for "V8" through "V1", and in the electronic document cited as an example, the drive reference speed and the drive reference phase are both made up of, for example, four bytes The electronic documents are transmitted through the network line 4, for example, at a speed of 20 megabits per second.

In each of the slave control sections 2 receiving the control electronic document being the drive reference, the slave network connecting section 21 outputs a signal to the operation command output section 32 when receiving the first drive reference. The operation command output section 32 receives the signal and outputs a signal to the operation control section 100.

On receiving the signal from the operation command output section 32, in the operation control section 100, the timing adjustment section 102 outputs a signal to operate the first moving means 90. This signal is amplified in the amplified signal output section 103 to operate the first moving means 90. The operation of the first moving means 90 brings the plate cylinder PC and the blanket cylinder BC forming the printing couple into contact with each other, and also brings the blanket cylinders BC of the adjacent printing couples into contact with each other.

In each of the slave control sections 2, which receives the control electronic document, the drive reference speed is inputted into the drive reference speed signal output section 22 and the drive reference phase is inputted into the drive reference phase signal output section 23 to be processed respectively.

Specifically, in the drive reference speed signal output section 22 into which the drive reference speed is inputted, by computation of $$S1=(Y2-Y1)/T$$

where the drive reference speed inputted this time is Y2, the drive reference speed inputted just before this is Y1, and a predetermined interval time during which the master control section 1 transmits the control electronic document is T, a value S1 proportional to the speed value set by the processing section 12 is obtained, then the value S1 is multiplied by a proper constant, and the analogue signal corresponding to the product thereof is outputted as the drive reference speed signal. As a result of reset of the value of the calculated sum of the first master pulse signals of the speed setting section 15 by the second master pulse signal, a case in which Y1>Y2, and therefore S1<—0 may occur, and in such a case, S1 is obtained by computation of $$=i\ S1=(Ym+Y2-Y1)/T$$

Ym is the number of the outputs of the first master pulse necessary to output the second master pulse signal, and is a predetermined value.

Each time the drive reference phase is inputted, the drive reference phase signal output section 23 into which the drive reference phase is inputted corrects the phase by a predetermined amount so that the printing image printed by the printing couple is in a correct relationship with the cutting position by the folding unit FD based on the length of the paper feeding route from each printing couple to the position for the cutting action of the folding unit FD and the assembly phase of the plate cylinder PC of the printing couple and the encoder 5 via the drive means MO as described above, and the corrected phase is outputted in a proper signal as the drive reference phase. The drive reference phase signal output section 23 of the slave control section 2 of #99 for controlling the drive means MO of the folding cylinder FC of the folding unit FD outputs the input drive reference phase inputted therein in a proper signal as the drive reference phase.

Aside from the above, in the slave control section 2, the output pulse signal of the encoder 5 provided at the drive means MO corresponding to each slave control section 2 is inputted into the feedback signal receiving section 28, and the output pulse signal of the encoder 5 inputted into the feedback signal receiving section 28 is processed in the feedback phase signal output section 27 and the feedback speed signal output section 29, respectively.

The feedback phase signal output section 27 calculates the sum of the pulse signals and the Z phase pulse signals the encoder 5 outputs, and outputs the value of the calculated sum in a proper signal as the rotational phase value of the drive means MO. In the calculation of feedback phase signal output section 27, the value of the calculated sum of the pulse signals is cleared by the Z phase pulse signal, and the value of the calculated sum of the Z phase pulse signals is cleared every time the value of the calculated sum reaches a predetermined number. The predetermined number of the value of the calculated sum of the Z phase pulse signals at which it is cleared is previously determined based on the ratio of the rotational speed of the driven part to the rotational speed of the encoder 5 as in the case in which the value of the calculated sum of the second master pulse signal in the aforementioned phase setting section 16 is cleared.

Further, the feedback speed signal output section 29 calculates the sum of the pulse signals and the Z phase pulse signals the encoder 5 outputs, and computes $$S2=(Y4-Y3)/T$$

where the value of the calculated sum is Y4, the value of the calculated sum when receiving the control electronic document just before it is Y3, the predetermined interval time during which the master control section 1 transmits the control electronic document is T, every time the slave network connecting section 21 receives the control electronic document, whereby a value S2 proportional to the rotational speed of the drive means MO is obtained, then it multiplies the value S2 by a proper constant, and outputs an analogue signal corresponding to the product thereof as a drive speed signal. As a result of reset of the value of the calculated sum of the pulse signals of the feedback speed signal output section 29 by the Z phase pulse signal, a case in which Y3>Y4, and therefore S2<0 may occur, and in this case, $$S2=(Yn+Y4-Y3)/T$$

is computed to obtain S2. Yn is the number of outputs of the pulse signals of the encoder 5, which are outputted between the two Z phase pulse signals before and after them. Yn is of the same number as the number of outputs Ym of the first master pulse signals necessary for the output of the aforementioned second master pulse signal, and is a predetermined value.

Further, in the slave control section 2, every time the slave network connecting section 21 receives a control electronic document, the drive electric power from the motor driver 31 to the drive means MO is corrected. The details are as follows.

Every time the slave network connecting section 21 receives the control electronic document, the drive reference phase signal output means 23 outputs a drive reference phase signal as described above. The drive reference phase signal is inputted into the phase deviation detection section 24. The rotational phase value of the driven part which the feedback phase signal output section 27 outputs, that is, the feedback phase signal, is also inputted into the phase deviation detection section 24.

Every time the drive reference phase signal is inputted, the phase deviation detection section 24 obtains a deviation of the rotational phase of the driven part from the drive reference phase from the drive reference phase signal and the feedback phase signal, and outputs the obtained deviation to the integral amplifier being the phase deviation signal output section 25. The phase deviation signal output section 25 outputs the analogue signal corresponding to the aforementioned input deviation as a phase deviation signal.

The aforementioned drive reference speed signal is corrected by the phase deviation signal in the first speed signal correction section 26 to be the first correction speed signal, and subsequently corrected by the drive speed signal in the second speed signal correction section 30 to be the second correction speed signal. The second correction speed signal is inputted into the motor driver 31.

The motor driver 31 into which the second correction speed signal is inputted corrects the drive electric power supplied to the drive means MO so that it conforms to the second correction speed signal.

In the operation control section 100 provided correspondingly to the slave control section 2 for which the choice of operation of the inking device 60 and the dampening device 70 is specified, the timing adjustment section 102 obtains a value proportional to the rotational speed of the drive means MO by the computation similar to the feedback speed signal output section 29 of the aforementioned slave control section 2, for example, at each proper time interval to detect the operation speed of the printing couple based on the output signal of the encoder 5, and every time this speed reaches the speed previously set so as to operate the second moving means 62, the third moving means 72, the ink pump group 63, and the dampening water injection nozzle group 73, the timing adjustment section 102 outputs an operation signal for the second moving means 62, the third moving means 72, the ink pump group 63, and the dampening water injection nozzle group 73. This signal is amplified in the amplified signal output section 103 to operate the second moving means 62, the third moving means 72, the ink pump group 63, and the dampening water injection nozzle group 73 in a predetermined order so as to be able to supply ink and dampening water.

On the other hand, on completion of the printing operation, when an operation signal for stop is inputted from the input operation section 11, the processing section 12 sets a speed value decelerating to stop in the master pulse signal output section 14 of the drive reference setting section 13, and finally stops the drive. Following this, the operation control section 100 provided correspondingly to the slave control section 2 to which the choice of operation of the aforementioned inking device 60 and dampening device 70 is specified operates the second moving means 62, the third moving means 72, the ink pump group 63, and the dampening water injection nozzle group 73 in a predetermined order every time the speed reaches a predetermined speed so as to stop the supply of ink and damping water. When the speed reaches a predetermined damping speed, the operation control section 100 outputs a signal to operate the first moving means 90. The operation of the first moving means 90 by this signal separates the plate cylinder PC and the blanket cylinder BC forming the printing couple, and separates the blanket cylinders BC of the adjacent printing couples from each other. The slave control section 2 controls the printing couples to synchronously drive to decelerate and stop following the drive reference which the master control section 1 outputs.

By the above described control, each driven part being an operation control target as a control range of the master control section 1 is specified based on the printing image information, and the drive means MO of the printing couple performs synchronous operation in which the printing cylinder being the driven part is adjusted in rotational phase so as to be in a predetermined relationship with the rotational phase of the folding cylinder FC of the folding unit FD and the rotational speed is matched thereto. The choice of operation of the inking device 60 and the dampening device 70 provided correspondingly to the printing couple is instructed based on the printing image information, and in accordance with the synchronous drive control of the printing couple, ink supply and dampening water supply by the inking device 60 and the dampening device 70 are started and stopped.

As explained thus far, according to the present invention, when a printing operation is performed by the rotary press including several multicolor printing units, it becomes possible to automatically select the printing sections which do not need to be operated, that is, the printing sections which can be stopped and exclude them from the synchronous operation control target based on absolutely necessary printing image information prior to the printing operation, which is extremely effective in energy saving, reduction in running cost, and improvement in operation safety.

Further, selection of the printing sections which do not need to be operated is dependable, and a failure to specify the printing sections to be specified can be eliminated, whereby the problems such as defective printed matters being produced and troubles in the printing process step are eliminated and a delay in operation is not caused.

Further, it is possible to automatically select the printing couples using the blanket cylinder as an impression cylinder to print only one face of the paper web, which are the printing couples that do not need supply of ink, that is, the printing couples ink supply to which is stopped, and exclude them from the ink supply operation target based on the printing image information, to say nothing of the printing couples of the printing sections which can be stopped, and it is also possible to automatically select the printing couples which need supply of ink and make them be the ink supply operation targets, whereby the present invention is extremely effective in many points in which energy saving by drive load reduction, running cost reduction such as prevention of exhaustion of an inking roller, favorable maintenance of the working environment by reduction in ink mist generation source, improvement in operation safety by reducing useless rotary operation parts can be surely carried out, and a failure to perform necessary ink supply and the like is prevented.

The printing couples which need ink supply and the printing couples which do not need ink supply are selected with reliability, and a failure to specify the printing couples which has to be specified as requiring ink supply can be eliminated, whereby the problems of defective printed matters being produced, troubles in the printing process step and the like do not occur, and a delay in operation is not caused.

What is claimed is:

1. In a rotary press having a plurality of multi color printing units with a combination of at least two sets of blanket-to-blanket printing sections, each of the blanket-to-blanket printing sections being constructed to comprise printing couples with a plate cylinder and a blanket cylinder being arranged to be able to contact each other and with the blanket cylinder of the printing couple and a blanket cylinder of another printing couple being provided to be able to contact each other, and an inking device provided for each of the printing couples, for supplying ink to a printing image on the plate cylinder, and to print the printing image on the plate cylinder on a paper web passing between the two blanket cylinders via the blanket cylinder, and the rotary press carrying out printing with use of a paper web conforming to each printing image area of the multicolor printing units, a synchronous control apparatus of a rotary press for selecting a control target based on printing image information, comprising:

a printing image allocation setting section for allocating a printing image which each of the printing couples is to print to the printing couple;

drive means provided for each of the printing couples to individually drive each of the printing couples;

inking transmission means connectable to and releasable from the drive means of the printing couples, for transmitting power of the drive means of the printing couples to the inking devices;

first moving means provided for each of the printing couples to move at least the blanket cylinder to a printing position at which the blanket cylinder and the plate cylinder of each of the printing couples are in contact with each other and the blanket cylinders of the two printing couples forming the blanket-to-blanket printing section are in contact with each other, and to a waiting position at which they are not in contact with each other;

second moving means provided for each of the inking devices to move at least one predetermined roller of the inking device provided for the printing couple to a position at which ink is supplied to the printing image on the plate cylinder of the printing couple and to a position at which ink is not supplied;

a slave control section provided for each of the drive means, for controlling rotation of the drive means;

an operation control section provided for each of the slave control sections, for controlling an operation of transmission means related to the printing couple and the inking device driven by the drive means controlled by the slave control section and operations of the first moving means and the second moving means in accordance with an output signal of the slave control section; and a master control section connected to said printing image allocation setting section and each of said slave control sections for transmitting and receiving information thereto and therefrom via a network, wherein said master control section specifies the slave control sections which it controls, based on information of the printing image allocation setting section, and transmits a control reference signal to the specified slave control sections, and the slave control sections instruct the operation control sections to output a signal according to the specification of the master signal.

2. The apparatus according to claim 1, wherein information regarding in which position of which printing couple in which multicolor printing unit an image is printed is set in said printing image allocation setting section.

3. The apparatus according to claim 2, wherein information regarding in which position of which printing couple in which multicolor printing unit an image is printed is set in said printing image allocation setting section, based on input of information necessary for setting printing image allocation information, which includes unit specification information specifying the multicolor printing units and folding unit to be used, number of pages information specifying the total number of pages of newspaper to be printed, and printing color information specifying the colors printed on each page in printing newspaper.

4. The apparatus according to claim 1, wherein regarding said master control section, any of the master control sections is properly specified, and the printing image allocation information set by the printing image allocation setting section is transmitted the master control section from the printing image allocation setting section.

5. The apparatus according to claim 2, wherein said master control section selects the printing couples to be supplied with ink in printing of this time, based on the printing image allocation information, then specifies the necessity of ink supply in the printing couples to the slave control sections for controlling the drive means of the printing couples, and transmits a signal being a control reference to each of the slave control sections specified to be the control target.

6. The apparatus according to claim 1, wherein said slave control sections instruct the operation control sections provided correspondingly to the slave control sections to bring the blanket cylinders of the printing couples driven by the drive means, which the slave control sections control, into a printable state, when said slave control sections are specified to be the control target by said master control section.

7. The apparatus according to claim 6, wherein when said slave control sections are specified as the control target by said master control section and specified as requiring ink supply, said slave control sections instruct the operation control sections provided correspondingly to the slave control sections to bring the inking devices provided correspondingly to the printing couples driven by the drive means, which the slave control sections control, into a state in which it is allowed to supply ink.

8. The apparatus according to claim 7, wherein each of the slave control sections specified as the control target by the master control section, to which the signal being a control reference is transmitted, controls an operation of the drive means, which the slave control section controls, in accordance with the received control reference.

9. The apparatus according to claim 1, wherein each of the slave control sections that are not specified as the control target and each of the slave control sections that are not specified as requiring ink supply do not give the instruction to bring the blanket cylinders of the printing couples driven by the drive means, which the slave control sections control, into a printable state to the operation control sections provided correspondingly to the slave control sections.

10. The apparatus according to claim 1, wherein the signal being a control reference is not transmitted to each of the slave control sections that are not specified as the control target from said master control section, and each of the slave control sections does not actuate the drive means which each of the slave control sections controls.

* * * * *